United States Patent [19]

Knickerbocker

[11] Patent Number: 4,471,893

[45] Date of Patent: Sep. 18, 1984

[54] VALVE ASSEMBLY WITH INTEGRAL PLASTIC SPRING

[75] Inventor: Michael G. Knickerbocker, Crystal Lake, Ill.

[73] Assignee: Seaguist Valve Company, Cary, Ill.

[21] Appl. No.: 338,967

[22] Filed: Jan. 12, 1982

Related U.S. Application Data

[63] Continuation-in-part of Ser. No. 225,138, Jan. 14, 1981, abandoned.

[51] Int. Cl.[3] ..... B65D 83/14

[52] U.S. Cl. ..... 222/402.22; 222/402.24; 251/354

[58] Field of Search ..... 222/402.1, 402.21, 402.22, 222/402.23, 402.24, 402.25, 514, 518; 239/573, 579; 251/353, 354

[56] References Cited

U.S. PATENT DOCUMENTS 3,482,784 12/1969 Webster ..... 239/573 X
3,642,180 2/1972 Lehmann ..... 222/402.21 X
3,825,159 7/1974 Laauwe ..... 222/402.24
3,827,609 8/1974 Arnaldo ..... 222/402.24
3,982,674 9/1976 Mildern ..... 222/402.24 X

*Primary Examiner*—F. J. Bartuska
*Attorney, Agent, or Firm*—Frijouf, Rust & Pyle

[57] ABSTRACT

A valve assembly is disclosed for use with an aerosol container having an integral plastic spring acting between the valve stem and the valve body. The valve body is disposed within the aerosol container adjacent a sealing gasket having a central aperture for receiving a valve stem extending therethrough. The valve stem has a valve stem sealing base for movement within an internal body cavity of the valve body to seal the valve stem when the base engages the sealing gasket and for enabling fluid flow when the base is displaced from the sealing gasket. The invention incorporates a plurality of resilient legs extending from the valve stem base for cooperation with an inclined surface either being a tapered or curved surface extending from the valve body to bias the stem sealer into engagement with the sealing gasket.

7 Claims, 15 Drawing Figures

VALVE ASSEMBLY WITH INTEGRAL PLASTIC SPRING

CROSS REFERENCE TO RELATED APPLICATION

This is a continuation-in-part of my pending application, Ser. No. 225,138 filed Jan. 14, 1981 now abandoned.

BACKGROUND OF THE INVENTION

1. Field of the Invention

This invention relates to fluid sprinkling and spraying and more particularly to an aerosol valve assembly having an integral biasing spring.

2. Description of the Prior Art

From the first development in the aerosol industry, all manufacturers have desired to increase the reliability and to decrease cost of the aerosol containers and valves therefor in an effort to provide cheaper and more reliable products for the industry. It is the desire of all manufacturers to decrease the total number of parts of an aerosol valve and to design each part so that the part may be manufactured in a reliable and efficient manner. Additional expenses are incurred during the manufacturer of aerosol valves due to the assembly cost of the aerosol valves. Each aerosol valve must be individually assembled and tested prior to shipment to the purchaser. The elimination of one part of the aerosol valve not only eliminates the cost of fabrication of only part but also eliminates a step in the assembly process. This twofold advantage by the reduction of a part from an aerosol valve has influenced manufacturers to combine two separate parts into a single part.

Aerosol valves generally comprise a valve body and a valve stem sealer which is biased against a sealing gasket by a mechanical spring such as a coil spring and the like. Some in the prior art have attempted to eliminate the use of a coil spring by molding a plastic spring onto the valve stem sealer.

One example of the prior art attempting to utilize an integral spring is shown in U.S. Pat. No. 3,482,784 to M. E. Webster. Webster uses a plurality of fingers engaging a valve body for providing an upward bias to the valve stem for replacing a conventional coil spring. Unfortunately, the Webster patent does not enable a long longitudinal displacement of the valve stem as required by most vertical action valve assemblies. In Webster, the movement of the valve stem is extremely limited, thus limiting the application of the device to very specific types of valve namely a tilt valve.

Another prior art teaching of an integral valve and spring is shown in U.S. Pat. No. 3,827,609 to Amabili. This patent utilizes an integral plastic spring to replace a conventional coil spring but similarly requires a specially designed valve body for proper operation.

Another aerosol valve assembly incorporating an integral plastic spring is taught by William D. Milderd, U.S. Pat. No. 3,982,674. Milderd uses a valve body in concert with a valve stem to provide an internal bias to the valve. This patent has a similar defect as the aforementioned patents in that a specific valve body is required having a completely different configuration from conventionally used aerosol valve assemblies.

Therefore it is an object of this invention to provide an apparatus which overcomes the aforementioned inadequacies of the prior art devices and provides an improvement which is a significant contribution to the advancement of the aerosol valve art.

Another object of this invention is to provide an aerosol valve assembly having an integral plastic spring which utilizes a valve body with only an internal modification therein thus making the aerosol valve compatible for use with conventional aerosol containers and mounting cups.

Another object of this invention is to provide an aerosol valve assembly for use with an aerosol container having an integral plastic spring wherein resilient means is provided between an internally modified valve body and a modified valve stem resulting in a valve assembly having an outward appearance identical to a conventional aerosol valve.

Another object of this invention is to provide an aerosol valve assembly for use with an aerosol container incorporating an integral plastic spring wherein the valve body includes a taper or a curved surface in an internal body cavity which surface forms an angular relationship relative to the axis of symmetry of the valve body.

Another object of this invention is to provide an aerosol valve assembly for use with an aerosol container having an integral plastic spring comprising a plurality of resilient legs disposed about the bottom portion of a valve stem sealer of the valve stem with the resilient legs having spaces therebetween for limiting the downward movement of the valve stem relative to the valve body.

Another object of this invention is to provide an aerosol valve assembly for use with an aerosol container having an integral plastic spring comprising a plurality of resilient legs for engagement with the taper or curved surface of the valve body thereby approximating the linearity and spring constant of a conventional coil spring.

Another object of this invention is to provide an aerosol valve assembly for use with an aerosol container having an integral plastic spring which is suitable for use with either a vertical action valve or a tilt valve.

The foregoing has outlined some of the more pertinent objects of the invention. These objects should be construed to be merely illustrative of some of the more prominent features and applications of the intended invention. Many other beneficial results can be attained by applying the invention within the scope of the disclosure. Accordingly, other objects and a fuller understanding of the invention may be had by referring to the summary of the invention and the detailed description describing the preferred embodiment in addition to the scope of the invention defined by the claims taken in combination with the accompanying drawings.

SUMMARY OF THE INVENTION

The invention is defined by the appended claims with a specific embodiment shown in the attached drawings. For the purpose of summarizing the invention, the invention may be incorporated into an aerosol valve assembly for use with an aerosol container for spraying aerosol products through a valve stem comprising a valve body having an internal body cavity. The invention includes a sealing gasket established between an upper periphery of the valve body and the mounting cup in a conventional manner as is well known to those skilled in the art. The sealing gasket includes a central aperture for receiving the valve stem therethrough. A valve stem sealer including a base is movably mounted within the internal body cavity for sealing the valve stem when the base engages the sealing gasket. The invention comprises a plurality of resilient legs extending from one of the valve stem sealer for resiliently engaging a tapered or curved surface extending from the valve body to bias the valve stem into sealing engagement with the sealing gasket. The resilient legs and the tapered or curved surface enables a substantial displacement of the valve stem base from the sealing gasket for use as a vertical action and/or tilt valve assembly.

In more specific embodiments of the invention, each of the resilient legs has a substantially curved cross-sectional area along the longitudinal length thereof. The plurality of resilient legs are preferably integrally disposed on the valve stem sealer.

The plurality of legs move along the tapered or curved surface of the aerosol valve body with the surface being established at an angular relationship relative to an axis of symmetry of the valve body. The cooperation between the resilient legs and the tapered or curved surface provides a bias with a spring constant approximating the spring constant of a coil spring. The resilient legs are spaced apart from one another and selected in accordance with the tapered or curved surface of the valve body to provide a positive stop to the valve stem upon contact of adjacent resilient legs thereby limiting the downward movement of the valve stem.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which.

Similar reference characters refer to similar parts throughout the several views of the drawings.

DETAILED DESCRIPTION

Figure 1:
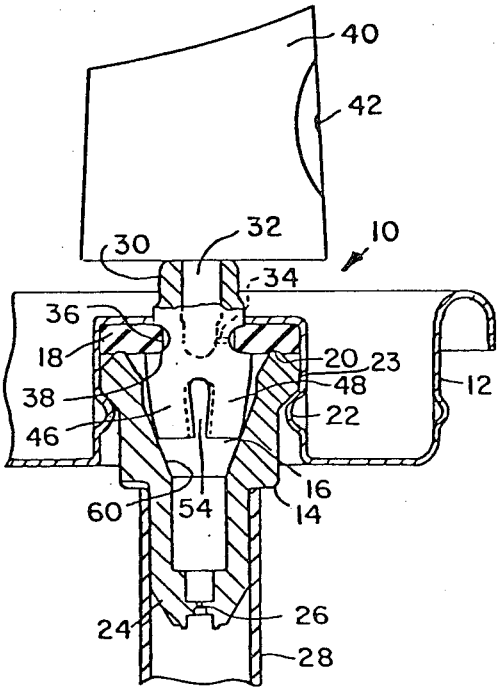
FIG. 1 is a side view partially in section of an improved aerosol valve mounted on an aerosol container.
Figure 3:
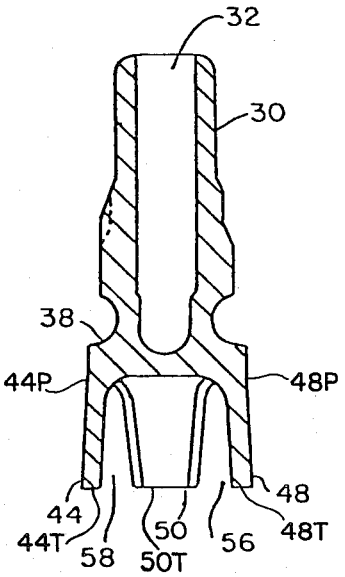
FIG. 3 is a sectional view along line 3—3 in FIG. 2.
Figure 4:
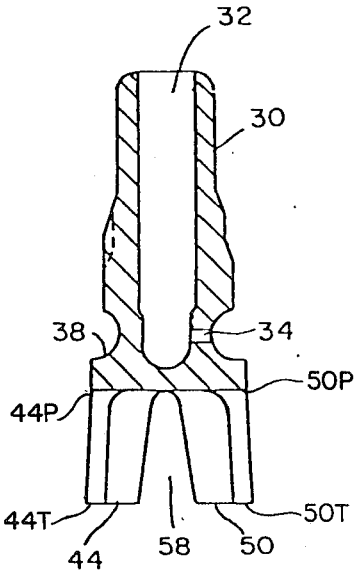
FIG. 4 is a sectional view along line 4—4 in FIG. 2.
Figure 5:
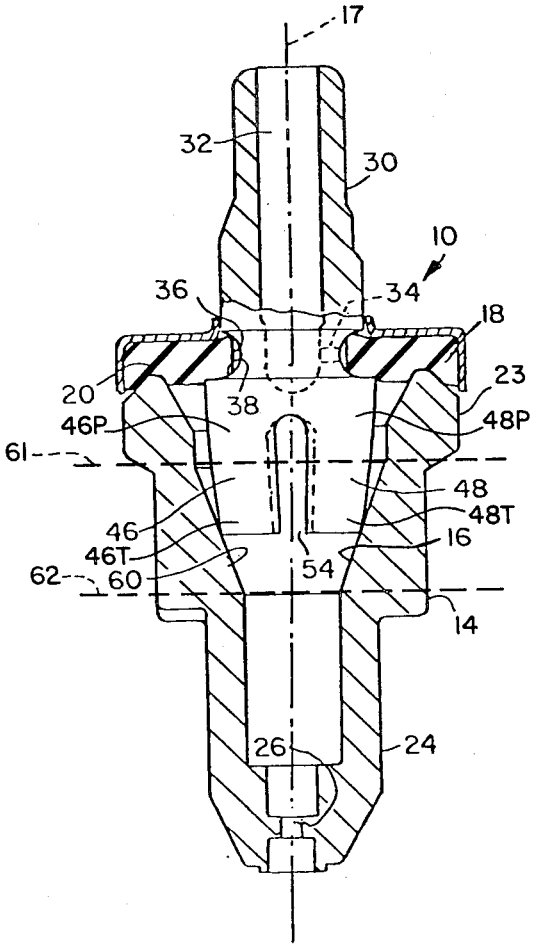
FIG. 5 is an enlarged view of the aerosol valve of FIG. 1 in a first position.

FIGS. 1-6 illustrate various views of a first embodiment of an improved aerosol valve assembly for use with an aerosol container incorporating a novel plastic spring. FIG. 1 shows the aerosol valve 10 mounted to a mounting cup 12 of an aerosol container (not shown) and comprising a valve body 14 having an internal body cavity 16 with substantially circular cross-sections about an axis of symmetry 17 as shown in FIG. 5. A sealing gasket 18 is disposed between the underside of the mounting cup 12 and the upper periphery 20 of the valve body 14 by means of a crimp 22 engaging an outer peripheral bead 23 as is well known in the art. The valve body 14 also includes a tail piece 24 having an aperture 26 for fluid communication with a dip tube 28 extending proximate the bottom of the aerosol container (not shown).

A valve stem 30 includes a stem orifice 32 in fluid communication with a metering aperture 34. The valve stem 30 extends through an aperture 36 in the sealing gasket 18 with a stem sealer or base 38 engaging the underside of the sealing gasket 18 for preventing fluid flow through the metering aperture 34. A valve button 40 includes a terminal orifice 42 which is in fluid communication with the stem orifice 32 providing a fluid flow path from the metering aperture 34 and through the stem orifice 32 to discharge from the terminal orifice 42 upon displacement of the stem sealer 38 from the sealing gasket 18.

The prior art valve assemblies utilize a metallic coil spring interacting between the valve body 14 and the stem sealer 38 for biasing the stem sealer 38 into engagement with the sealing gasket 18. The instant invention comprises novel resilient means for urging the stem sealer 38 into engagement with the sealing gasket 18. A first embodiment of the invention is shown in FIGS. 1-4 with the operation being specifically shown in FIGS. 5 and 6.

Figure 2:
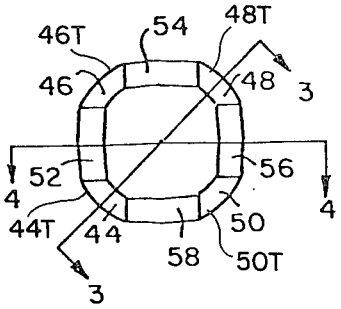
FIG. 2 is a bottom view of the valve stem shown in FIG. 1 when removed from the valve body.

FIG. 2 is a bottom view of the valve stem 30 when removed from the valve body 14 showing a plurality of resilient means shown as four resilient legs 44, 46, 48 and 50 spaced relative to one another defining leg spacings 52, 54, 56 and 48 therebetween. FIGS. 3 and 4 are sectional views along lines 3—3 and 4—4, respectively in FIG. 2 illustrating in greater detail the construction of the resilient legs and the leg spacings. Each of the resilient legs has a proximal end 44P, 46P, 48P and 50P and a terminal end 44T, 46T, 48T and 50T. The outer surface of each of the resilient legs has a curved area for cooperation with the circular cross-section of the body cavity 16. The leg spacings 52, 54, 56 and 58 are uniformly distributed about the resilient legs and are selected to be of an appropriate size for interaction with one another as will be hereinafter described. Although four resilient legs have been disclosed in this embodiment, it is understood that this number may be altered to any plurality of resilient legs so long as the leg spacing distance is sufficient for proper operation of the valve.

Figure 6:
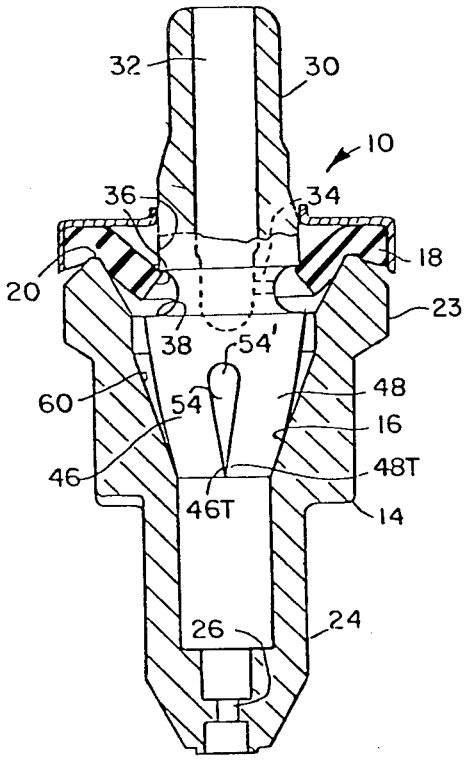
FIG. 6 is an enlarged view of the aerosol valve of FIG. 1 in a second position.

FIGS. 5 and 6 are enlarged views of a portion of the valve assembly shown in FIG. 1 showing in greater detail the operation of the aerosol valve. FIG. 5 illustrates the position whereby the resilient legs 46 and 48 are slightly compressed by action of a taper wall portion 60 of the internal body cavity 16 defined between a first circular cross-section 61 and a second circular cross-section 62 established proximate the outer peripheral bead 23 and the tailpiece 24. The valve stem sealer 38 has a substantially circular cross-section which is less than the first circular cross-section 61 but greater than the second circular cross-section 62 enabling fluid flow between the valve stem sealer 38 and the wall of the body cavity 16. The tapered wall portion 60 is shown in this embodiment as a cone and is of utmost importance to the operation of the device and is selected to efficiently allow the resilient legs to move along the tapered wall portion and to enable substantial movement of the valve stem 30 relative to the valve body 14. Preferably, the tapered wall portion 60 is between 10 and 30 degrees relative to the axis of symmetry 17 extending through the valve body 14. The tapered wall portion 60 slightly compresses the resilient legs 44, 46, 48 and 50 to bias the sealing base 38 into sealing engagement with the sealing gasket 18. The leg spacings including leg spacing 54, are selected to be in accordance with the taper surface 60 such that depression of the valve stem in a vertical position as shown in FIG. 6 causes continued deformation of the resilient legs. The deformation of the legs continues until the terminal end of adjacent resilient legs contact one another as shown in FIG. 6 to limit the movement of the valve stem 30 in a vertical direction. It should be appreciated that the valve stem 30 is now in a maximum vertically depressed position wherein the terminal ends of the legs 44, 46, 48 and 50 are contacting one another as shown by terminal ends 46T and 48T with similar contacts being established about the periphery of the valve stem sealer 38. The leg spacings 52, 54, 56 and 58 adjacent the proximal ends 44P, 46P, 48P and 50P provide a plurality of orifices, one shown as 54', to enable fluid flow therethrough when the valve stem 30 is in the position shown in FIG. 6.

The selection of the horizontal width of the leg spacings 52, 54, 56 and 58 together with the selection of the angle of the tapered wall portion 60 enables the resilient means to be slightly deformed in the position shown in FIG. 5 when the sealing base is engaging the sealing gasket and for limiting the vertical depression of the valve stem upon contact of adjacent resilient legs as shown in FIG. 6. This cooperation is a substantial feature of the present invention and is a superior advancement over the prior art.

Figure 7:
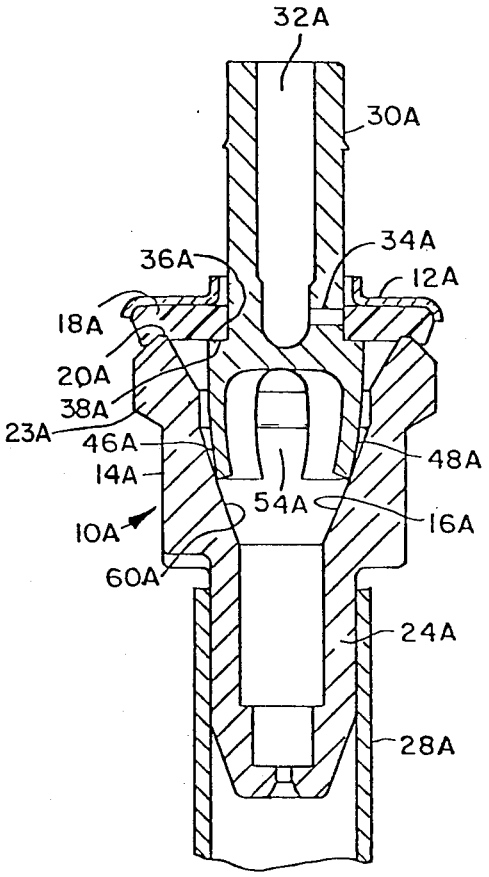
FIG. 7 is a sectional view of a second embodiment of the invention in a first position.
Figure 8:
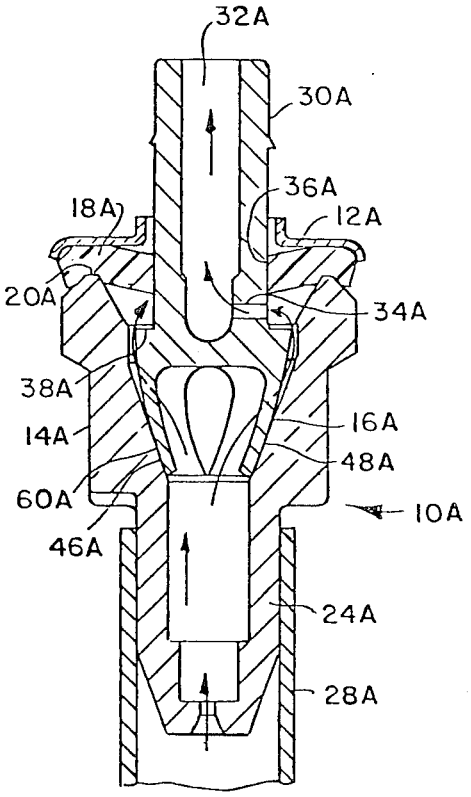
FIG. 8 is the valve of FIG. 7 in a second position.

FIGS. 7 and 8 show a second embodiment of the invention with the valve 10A being shown in a closed position in FIG. 7 and in an open position in FIG. 8. The reference numerals in FIGS. 7 and 8 refer to similar parts as in FIGS. 1–6 with the addition of the letter "A". In this embodiment, the valve stem 30A is substantially cylindrical along the length whereas the stem sealer 38A extends radially outwardly therefrom. The stem sealer 38A engages the underside of the sealing gasket 18A with bias being furnished by a plurality of resilient legs, including legs 46A and 48A.

FIG. 8 illustrates the valve assembly in the open position wherein the resilient legs 46A and 48A are compressed to contact one another to limit the downward movement of the valve stem 30A. This structure provides a positive stop for the downward movement of the valve stem 30A. In this embodiment, the gasket 18A is not substantially displaced from the closed position in FIG. 7 in contrast to the first embodiment shown in FIGS. 1–6.

Figure 9:
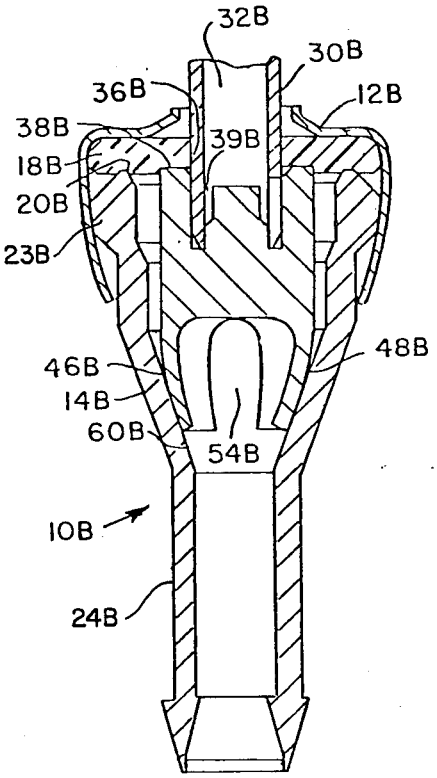
FIG. 9 is a sectional view of a third embodiment of the invention in a first position.
Figure 10:
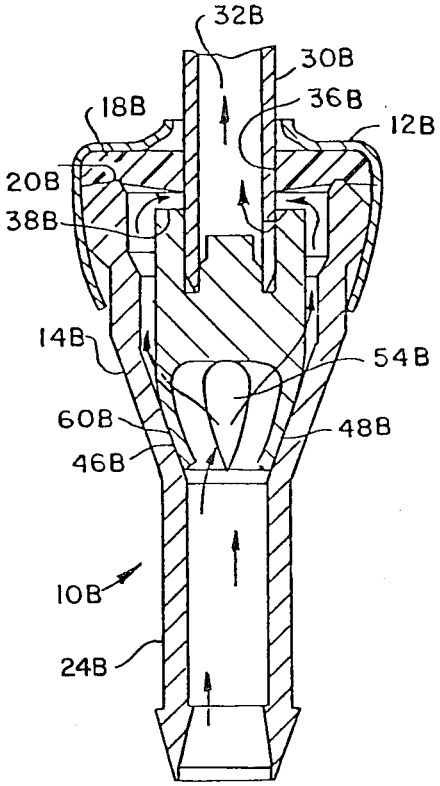
FIG. 10 is the valve of FIG. 9 in a second position.

FIGS. 9 and 10 illustrate a third embodiment of the invention with similar reference numerals in FIGS. 9 and 10 referring to similar parts as in FIGS. 1–6 with the addition of the letter "B". The aerosol valve 10B includes a separate valve stem 30B and a valve stem sealer 38B. The valve stem sealer 38B includes a socket 39B for receiving the terminal end of the valve stem 30B therein. The plurality of resilient legs, including legs 46B and 48B, are integrally disposed on the stem sealer 38B.

FIG. 10 shows the valve 10B in the second or open position wherein the stem sealer 38B is displaced from the sealing gasket 18B. The plurality of resilient legs, including legs 46B and 48B, function as heretofore described to limit the downward movement of the valve stem 30B. The third embodiment shown in FIGS. 9 and 10 is commonly referred to as a "female" valve wherein the valve stem 30B is integrally attached to the valve button and may be removed from the aerosol; container while the container is in a pressurized condition.

Figure 11:
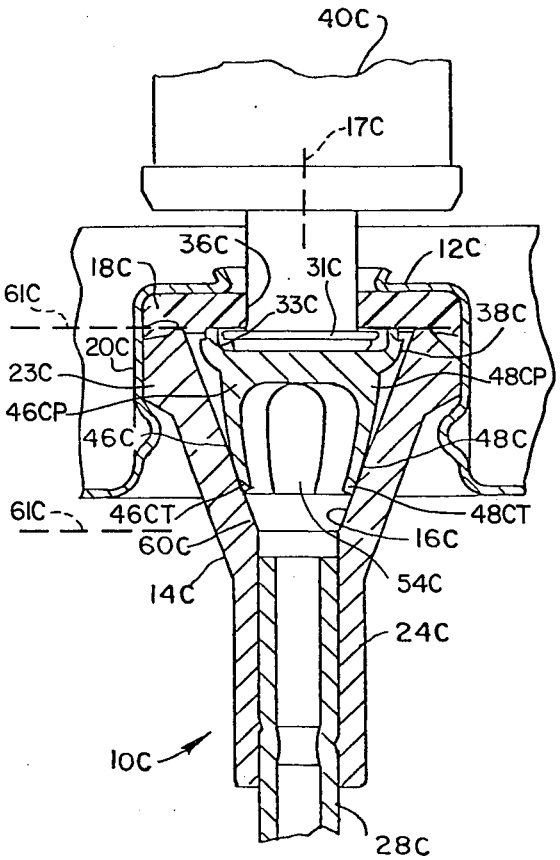
FIG. 11 is a sectional view of a fourth embodiment of the invention in a first position.
Figure 12:
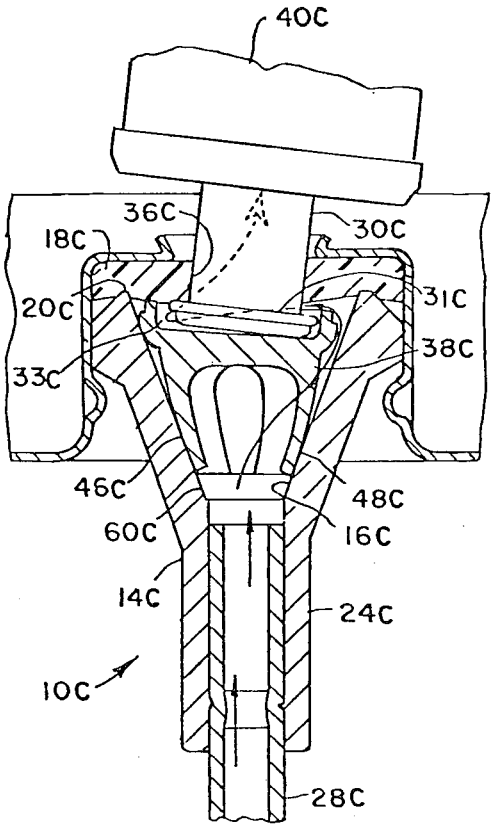
FIG. 12 is the valve of FIG. 11 in a second position.

A fourth embodiment of the invention is illustrated in FIGS. 11 and 12. In this embodiment, the plurality of resilient legs are incorporated into a tilt valve 10C. The tilt valve comprises a valve stem 30C having a stem head 31C which is disposed within a chamber 33C of a valve stem sealer 38C. The upper periphery of the valve stem sealer 38C in addition to the stem head 31C forms a seal with the gasket 18C as shown in FIG. 11. Upon tilting of the valve stem 30C as in FIG. 12, the resilient legs 46C and 48C deform enabling fluid flow through the aerosol valve 10C as indicated by the arrows. The function of the resilient legs within the tilt valve in FIGS. 11 and 12 is substantially identical to that heretofore described.

Figure 13:
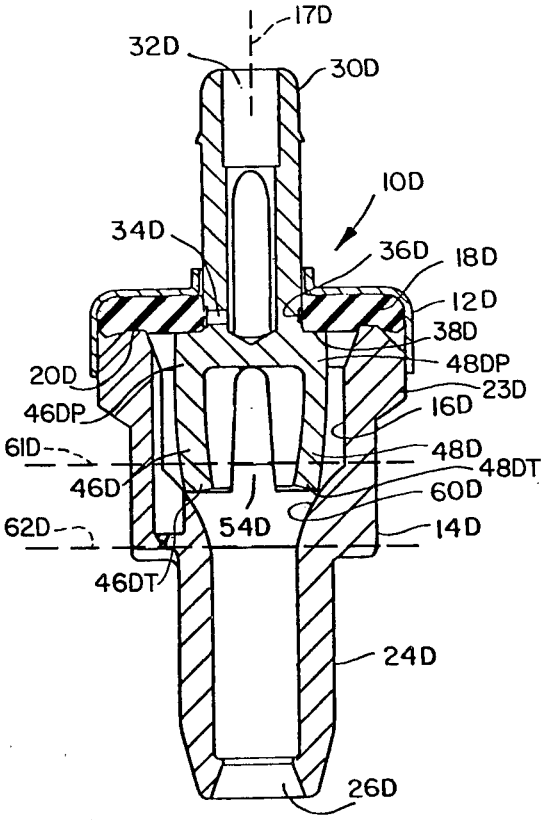
FIG. 13 is a sectional view of a fifth embodiment of the invention in a first position.
Figure 14:
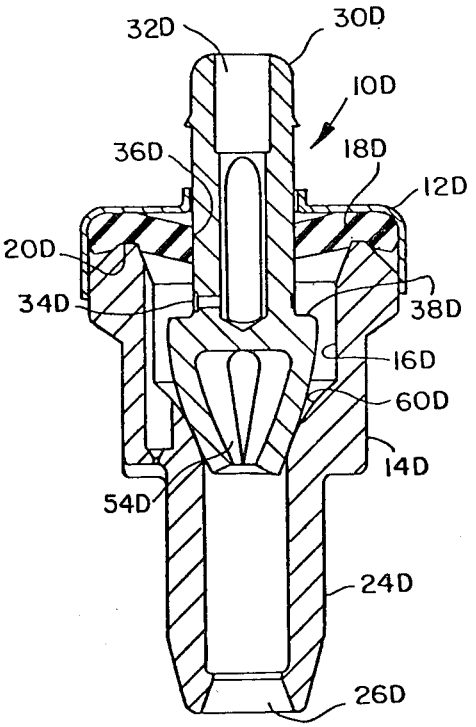
FIG. 14 is the valve of FIG. 13 in a second position.

FIGS. 13 and 14 show a fifth embodiment of the invention with the valve 10D being in the closed position in FIG. 13 and in an open position in FIG. 14. The reference numerals in FIGS. 13 and 14 refer to similar parts as in FIGS. 1–6 with the addition of the letter "D". The aerosol valve 10D is mounted to mounting cup 12D of the aerosol container (not shown) with a valve body 14D having an internal body cavity 16D having substantially circular cross-sections about an axis of symmetry 17D. A sealing gasket 18D is disposed between the underside of mounting cup 12D and the upper periphery 20D of the valve body. A valve body tailpiece 24D has an aperture 26D for fluid communication with a dip tube (not shown). The valve stem 30D which is similar to the embodiments in FIGS. 7 and 8, includes a stem orifice 32D in fluid communication with a metering aperture 34D. A stem sealer or base 38D engages the underside of sealing gasket 18D for preventing fluid flow through the metering aperture 34D. The resilient means in this embodiment is shown as a plurality of resilient legs including 46D and 48D spaced relative to one another by a plurality of leg spacings one shown as 54D in a manner similar to FIGS. 1–8. Each of the resilient legs has a proximal end shown as 46DP and 48DP and terminal end 46DT and 48DT. The outer surfaces of the resilient legs have a curved surface area for cooperation with the circular cross-section of the body cavity 16D. The leg spacings, one shown as 54D, are uniformly distributed about the resilient legs and are selected to be of an appropriate size for interaction with one another as described heretofore and hereinafter.

The embodiment in FIGS. 13 and 14 utilize a curved tapered wall portion 60D instead of the conically tapered wall portion as explained with reference to FIGS. 1–12. The curved tapered wall portion 60D is defined between a first circular cross-section 61D and a second circular cross-section 62D established proximate the outer peripheral bead 23D and the tail piece 24D. The tapered wall portion 62D defines a curve between the first and second cross-sections 61D and 62D relative to the axis of symmetry 17D of the valve body 14D. In this embodiment, the curved tapered wall portion is shown as a semi-circular curved taper for cooperating with the resilient legs to provide improved performance of the spring tension in many applications over the inventions shown in FIGS. 1–12. In a specific embodiment of the invention, the curved tapered wall portion 60D has a radius of approximately 0.200 inches. However, portions of a sphere, ellipsoid, paraboloid, hyperboloid, or combinations thereof including multiple curved surfaces may find application in this invention. The cooperation of the resilient legs as heretofore described in combination with the curved tapered wall portion 60D provides superior performance to this invention. Although a semi-circular curve taper has been disclosed with reference to FIGS. 13 and 14, it should be understood that numerous other curve surfaces, including complex curves, may be resorted to for various applications of spring tension. These variations should be construed to be incorporated within the instant invention.

The valve 10D shown in FIGS. 13 and 14 operates in a manner similar to that heretofore described with reference to FIG. 23 showing valve 10D in the unattended position whereas FIG. 14 illustrates the valve in the maximum downward position with adjacent terminal end 46DT and 48DT of the resilient legs 46D and 48D in engagement to limit the vertical depression of the valve stem 30D.

Figure 15:
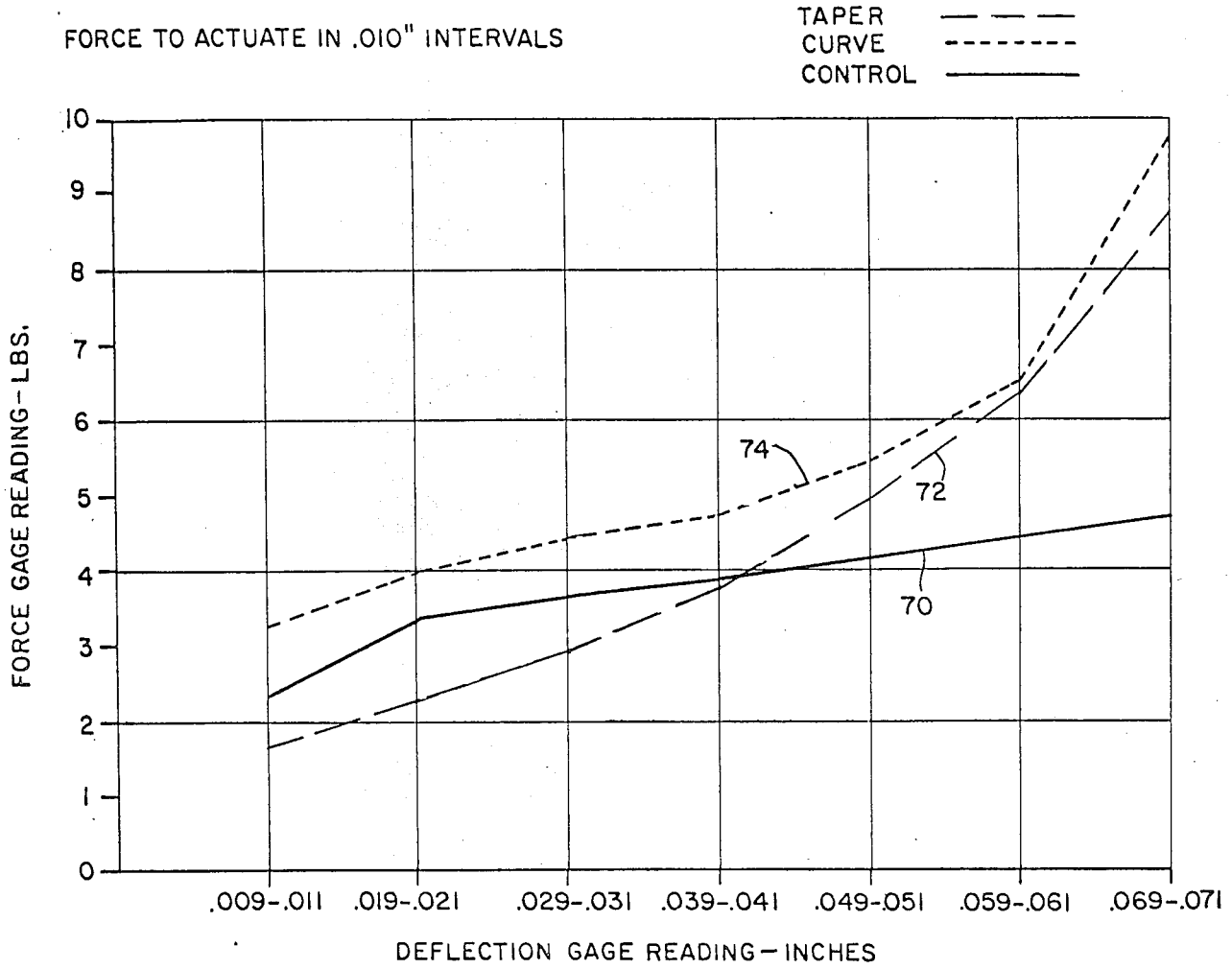
FIG.15 is a graph of force as a function of displacement for selected embodiments of the invention.

FIG. 15 is a graph showing displacement force as a function of stem displacement for a conventional coil spring and for the embodiments shown in FIGS. 7 and 13, respectively. Graph 70 illustrates the relationship between displacement force and displacement for a conventional metallic coil spring. Graph 70 illustrates the relationship between displacement force and displacement for a conventional metallic coil spring. Graph 73 illustrates the same data for the valve 10A whereas graph 74 represents the graph of displacement force as a function of displacement for the valve embodiment 10D as shown in FIG. 13. The interrelation of the resilient legs in combination with the curved surface 60D provides a curve 74 which approximates the conventional coil spring graphs. It should be apparent to those skilled in the art that the performance features of the valve assembly 10D incorporating the curved surface 60D has superior performance to the valve 10A shown in FIGS. 7 and 8. However, numerous applications may require either the tapered or the curved surface or a combination of both, with either a single or a multiple curved internal surface, depending upon the particular application.

It should be appreciated by those skilled in the art that the various embodiments may be interchanged and that the curved surface 60D of FIGS. 13 and 14 may be incorporated into any of the valve assemblies shown as sell as incorporated into numerous other types of An important aspect of the subject invention is the cooperation of the substantially curved legs as shown in FIG. 2 with the circular cross-section of the body cavity 16. This cooperation provides a smooth and reliable movement of the valve stem which was not found in the prior art. The curve in the leg provides strength to the leg as well as providing a greater area of contact with the tapered wall portion.

The present disclosure includes that contained in the appended claims as well as that of the foregoing description. Although this invention has been described in the preferred form with a certain degree of particularity, it is understood that the present disclosure of the preferred form has been made only by way of example and that numerous changes in the details and construction and the combination and arrangement of parts may be resorted to without departing from the spirit and scope of the invention.

Now that the invention has been described, I claim:

What is claimed is:

1. An aerosol valve assembly disposed in a mounting cup for use with an aerosol container for spraying aerosol product through a valve stem, comprising in combination:

a valve body having an outer peripheral bead for engaging with the mounting cup;

said valve body having a tailpiece for fluid communication through a dip tube to the interior of the aerosol container;

a sealing gasket established between an upper periphery of said valve body and the aerosol container;

said sealing gasket having a central aperture for receiving the valve stem therein;

said valve body comprising an internal body cavity having substantially circular cross-sections about an axis of symmetry of said valve body with said circular cross-sections decreasing in size from a first circular cross-section proximate said outer peripheral bead to a second circular cross-section proximate said tailpiece defining a tapered wall portion of said internal cavity;

a valve stem sealer means movably mounted within said internal body cavity for sealing said valve stem when said valve stem sealer means engages said sealing gasket and for enabling fluid flow of the aerosol product through said dip tube and the valve stem when the valve stem sealer means is displaced from said sealing gasket;

said valve stem sealer means having a substantially circular cross-section which is less than said first circular cross-section and greater than said second circular cross-section enabling the flow of aerosol product between said valve stem sealer and said valve body;

a plurality of resilient legs each having a proximal end and a terminal end with said proximal ends connected to said valve stem sealer means and with each of said resilient legs being spaced from one another defining leg spacings therebetween;

said terminal ends of each of said resilient legs continuously contacting said tapered wall portion and continuously being under compression radially toward said axis of symmetry of said valve body by said tapered wall portion for biasing said valve stem sealer means into sealing engagement with said sealing gasket; and said plurality of resilient legs limiting the displacement of said valve stem sealer means upon the terminal ends of said resilient legs engaging one another concomitantly with said leg spacings adjacent said proximal ends of said resilient legs enabling aerosol product to flow from the interior of said aerosol container through said dip tube and tailpiece and through said leg spacings adjacent said proximal ends of said resilient legs to flow between said valve stem sealer and said valve body to enter the valve stem.

2. An aerosol valve assembly as set forth in claim 1, wherein said tapered wall portion extends at an angle between ten and thirty degrees relative to said axis of symmetry of said valve body.

3. An aerosol valve assembly disposed in a mounting cup for use with an aerosol container for spraying aerosol product through a valve stem, comprising in combination:

a valve body having an outer peripheral bead for engaging with the mounting cup;

said valve body having a tailpiece for fluid communication through a dip tube to the interior of the aerosol container;

a sealing gasket established between an upper periphery of said valve body and the aerosol container;

said sealing gasket having a central aperture for receiving the valve stem therein;

said valve body comprising an internal body cavity having substantially circular cross-sections about an axis of symmetry of said valve body with said circular cross-sections decreasing in size from a first circular cross-section proximate said outer peripheral bead to a second circular cross-section proximate said tailpiece defining a conically tapered wall portion of said internal body cavity;

a valve stem sealer means movably mounted within said internal body cavity for sealing said valve stem when said valve stem sealer means engages said sealing gasket and for enabling fluid flow of the aerosol product through said dip tube and the valve stem when the valve stem sealer means is displaced from said sealing gasket;

said valve stem sealer means having a substantially circular cross-section which is less than said first circular cross-section and greater than said second circular cross-section enabling the flow of aerosol product between said valve stem sealer and said valve body;

a plurality of resilient legs each having a proximal end and a terminal end with said proximal ends connected to said valve stem sealer means and with each of said resilient legs being spaced from one another defining leg spacings therebetween;

said terminal ends of each of said resilient legs continuously contacting said conically tapered wall portion and continuously being under compression radially toward said axis of symmetry of said valve body by said conically tapered wall portion for biasing said valve stem sealer means into sealing engagement with said sealing gasket; and said plurality of resilient legs limiting the displacement of said valve stem sealer means upon the terminal ends of said resilient legs engaging one another concomitantly with said leg spacings adjacent said proximal ends of said resilient legs enabling aerosol product to flow from the interior of said aerosol container through said dip tube and tailpiece and through said leg spacings adjacent said proximal ends of said resilient legs to flow between said valve stem sealer and said valve body to enter the valve stem.

4. An aerosol valve assembly disposed in a mounting cup for use with an aerosol container for spraying aerosol product through a valve stem, comprising in combination:

a valve body having an outer peripheral bead for engaging with the mounting cup;

said valve body having a tailpiece for fluid communication through a dip tube to the interior of the aerosol container;

a sealing gasket established between an upper periphery of said valve body and the aerosol container;

said sealing gasket having a central aperture for receiving the valve stem therein;

said valve body comprising an internal body cavity having substantially circular cross-sections about an axis of symmetry of said valve body with said circular cross-sections decreasing in size from a first circular cross-section proximate said outer peripheral bead to a second circular cross-section proximate said tailpiece defining a tapered wall portion of said internal body cavity;

said tapered wall portion defining a curve between said first and second circular cross-sections relative to said axis of symmetry of said valve body;

a valve stem sealer means movably mounted within said internal body cavity for sealing said valve stem when said valve stem sealer means engages said sealing gasket and for enabling fluid flow of the aerosol product through said dip tube and the valve stem when the valve stem sealer means is displaced from said sealing gasket;

said valve stem sealer means having a substantially circular cross-section which is less than said first circular cross-section and greater than said second circular cross-section enabling the flow of aerosol product between said valve stem sealer and said valve body;

a plurality of resilient legs each having a proximal end and a terminal end with said proximal ends connected to said valve stem sealer means and with each of said resilient legs being spaced from one another defining leg spacings therebetween;

said terminal ends of each of said resilient legs continuously contacting said tapered wall portion and continuously being under compression radially toward said axis of symmetry of said valve body by said tapered wall portion for biasing said valve stem sealer means into sealing engagement with said sealing gasket; and said plurality of resilient legs limiting the displacement of said valve stem sealer means upon the terminal ends of said resilient legs engaging one another concomitantly with said leg spacings adjacent said proximal ends of said resilient legs enabling aerosol product to flow from the interior of said aerosol container through said dip tube and tailpiece and through said leg spacings adjacent said proximal ends of said resilient legs to flow between said valve stem sealer and said valve body to enter the valve stem.

5. An aerosol valve assembly disposed in a mounting cup for use with an aerosol container for spraying aerosol product through a valve stem, comprising in combination:

a valve body having an outer peripheral bead for engaging with the mounting cup;

said valve body having a tailpiece for fluid communication through a dip tube to the interior of the aerosol container;

a sealing gasket established between an upper periphery of said valve body and the aerosol container;

said sealing gasket having a central aperture for receiving the valve stem therein;

said valve body comprising an internal body cavity having substantially circular cross-sections about an axis of symmetry of said valve body with said circular cross-sections decreasing in size from a first circular cross-section proximate said outer peripheral bead to a second circular cross-section proximate said tailpiece defining a tapered wall portion of said internal body cavity;

a valve stem sealer means movably mounted within said internal body cavity for sealing said valve stem when said valve stem sealer means engages said sealing gasket and for enabling fluid flow of the aerosol product through said dip tube and the valve stem when the valve stem sealer means is vertically displaced from said sealing gasket;

said valve stem sealer means having a substantially circular cross-section which is less than said first circular cross-section and greater than said second circular cross-section enabling the flow of aerosol product between said valve stem sealer and said valve body;

a plurality of resilient legs each having a proximal end and a terminal end with said proximal ends integrally connected to said valve stem sealer means and with each of said resilient legs being spaced from one another defining leg spacings therebetween;

said terminal ends of each of said resilient legs continuously contacting said tapered wall portion and continuously being under compression radially toward said axis of symmetry of said valve body by said tapered wall portion for biasing said valve stem sealer means into sealing engagement with said sealing gasket; and said plurality of resilient legs limiting the vertical displacement of said valve stem sealer means upon the terminal ends of said resilient legs engaging one another concomitantly with said leg spacings adjacent said proximal ends of said resilient legs enabling aerosol product to flow from the interior of said aerosol container through said dip tube and tailpiece and through said leg spacings adjacent said proximal ends of said resilient legs to flow between said valve stem sealer and said valve body to enter the valve stem.

6. A vertical action aerosol valve assembly disposed in a mounting cup for use with an aerosol container for spraying aerosol product through a valve stem, comprising in combination:

a valve body having an outer peripheral bead for engaging with the mounting cup;

said valve body having a tailpiece for fluid communication through a dip tube to the interior of the aerosol container;

a sealing gasket established between an upper periphery of said valve body and the aerosol container;

said sealing gasket having a central aperture for receiving the valve stem therein;

said valve body comprising an internal body cavity having substantially circular cross-sections about an axis of symmetry of said valve body with said circular cross-sections decreasing in size from a first circular cross-section proximate said outer peripheral bead to a second circular cross-section proximate said tailpiece defining a tapered wall portion of said internal body cavity;

a valve stem sealer means movably mounted within said internal body cavity for sealing said valve stem when said valve stem sealer means engages said sealing gasket and for enabling fluid flow of the aerosol product through said dip tube and the valve stem when the valve stem sealer means is vertically displaced along said axis of symmetry from said sealing gasket;

said valve stem sealer means having a substantially circular cross-section which is less than said first circular cross-section and greater than said second circular cross-section enabling the flow of aerosol product between said valve stem sealer and said valve body;

a plurality of resilient legs each having a proximal end and a terminal end with said proximal ends connected to said valve stem sealer means and with each of said resilient legs being spaced from one another defining leg spacings therebetween;

said terminal ends of each of said resilient legs continuously contacting said tapered wall portion and continuously being under compression radially toward said axis of symmetry of said valve body by said tapered wall portion for biasing said valve stem sealer means into sealing engagement with said sealing gasket; and said plurality of resilient legs limiting the vertical displacement of said valve stem sealer means upon the terminal ends of said resilient legs engaging one another concomitantly with said leg spacings adjacent said proximal ends of said resilient legs enabling aerosol product to flow from the interior of said aerosol container through said dip tube and tailpiece and through said leg spacings adjacent said proximal ends of said resilient legs to flow between said valve stem sealer and said valve body to enter the valve stem.

7. A tilt aerosol valve assembly disposed in a mounting cup for use with an aerosol container for spraying aerosol product through a valve stem, comprising in combination:

a valve body having an outer peripheral bead for engaging with the mounting cup;

said valve body having a tailpiece for fluid communication through a dip tube to the interior of the aerosol container;

a sealing gasket established between an upper periphery of said valve body and the aerosol container;

said sealing gasket having a central apparatus for receiving the valve stem therein;

said valve body comprising an internal body cavity having substantially circular cross-sections about an axis of symmetry of said valve body with said circular cross-sections decreasing in size from a first circular cross-section proximate said outer peripheral bead to a second circular cross-section proximate said tailpiece defining a tapered wall portion of said internal body cavity;

a valve stem sealer means movably mounted within said internal body cavity for sealing said valve stem when said valve stem sealer means engages said sealing gasket and for enabling fluid flow of the aerosol product through said dip tube and the valve stem when the valve stem sealer means is displaced from said sealing gasket;

said valve stem sealer means having a substantially circular cross-section which is less than said first circular cross-section and greater than said second circular cross-section enabling the flow of aerosol product between said valve stem sealer and said valve body;

a plurality of resilient legs each having a proximal end and a terminal end with said proximal ends connected to said valve stem sealer means and with each of said resilient legs being spaced from one another defining leg spacings therebetween;

said terminal ends of each of said resilient legs continuously contacting said tapered wall portion and continuously being under compression radially toward said axis of symmetry of said valve body by said tapered wall portion for biasing said valve stem sealer means into sealing engagement with said sealing gasket; and said plurality of resilient legs limiting the displacement of said valve stem sealer means upon the terminal ends of said resilient legs engaging one another concomitantly with said leg spacings adjacent said proximal ends of said resilient legs enabling aerosol product to flow from the interior of said aerosol container through said dip tube and tailpiece and through said leg spacings adjacent said proximal ends of said resilient legs to flow between said valve stem sealer and said valve body to enter the valve stem.

* * * * *

UNITED STATES PATENT AND TRADEMARK OFFICE

CERTIFICATE OF CORRECTION

PATENT NO. : 4,471,893

DATED : September 18, 1984

INVENTOR(S) : Michael G. Knickerbocker

It is certified that error appears in the above-identified patent and that said Letters Patent are hereby corrected as shown below:

In the Abstract

Column 1, line 29, after "elimination of" insert --only--.
Column 1, line 30, after "fabrication of" delete "only" and insert --the--.
Column 2, lines 64-65, delete "mounting cup" and insert --aerosol container--.
Column 3, line 2, after "gasket." insert -- The valve stem sealer enables fluid flow of the aerosol product through the valve stem when the base is displaced from the sealing gasket.--
Column 3, line 4, delete "one of".
Column 3, lines 16 and 17, delete paragraph indention and follow with line 17 on line 16 after "sealer."
Column 6, line 54, after "embodiments" insert --shown--.
Column 7, line 10, delete "62D" and insert --60D--.
Column 7, lines 33 and 34, delete "reference to Fig. 23" and insert --Fig. 13--.
Column 7, lines 46-48, delete the second duplicate sentence "Graph 70 illustrates the relationship between displacement force and displacement for a conventional metallic coil spring."
Column 7, line 49, delete "73" and insert --72--.

UNITED STATES PATENT AND TRADEMARK OFFICE

CERTIFICATE OF CORRECTION

PATENT NO. : 4,471,893

DATED : September 18, 1984

INVENTOR(S) : Michael G. Knickerbocker

It is certified that error appears in the above-identified patent and that said Letters Patent are hereby corrected as shown below:

Column 7, line 53, delete "surface" and insert --tapered wall portion--.
Column 7, line 57, delete "surface" and insert --tapered wall portion--.
Column 7, line 66, delete "surface" and insert --tapered wall portion--.
Column 7, line 68, delete "sell" and insert --well--.
Column 7, line 68, after "types of" insert --valve assemblies which should be apparent to those skilled in the art.--
Column 8, line 41, after "internal" insert --body--.
Column 12, line 54, delete "apparatus" and insert --aperture--.

Signed and Sealed this

*Twenty-first* Day of *May 1985*

[SEAL]

*Attest:*

DONALD J. QUIGG

*Attesting Officer* *Acting Commissioner of Patents and Trademarks*